United States Patent [19]

Stockdale

[11] 4,361,740

[45] Nov. 30, 1982

[54] SEISMIC SENSOR APPARATUS

[75] Inventor: Roy Stockdale, Huntington, N.Y.

[73] Assignee: Napco Security Systems, Inc., Copaigue, N.Y.

[21] Appl. No.: 238,935

[22] Filed: Feb. 27, 1981

[51] Int. Cl.[3] ..... H01H 35/14

[52] U.S. Cl. ..... 200/61.45 R; 200/61.93; 340/566

[58] Field of Search ..... 200/61.45 R, 61.45 M, 200/61.46, 61.47, 61.48, 61.49, 61.5, 61.51, 61.53, 61.93; 340/566, 541; 73/652; 307/10 AT

[56] References Cited

U.S. PATENT DOCUMENTS

| | | | |
|---|---|---|---|
| 3,521,266 | 1/1970 | Hall | 340/566 |
| 3,559,203 | 1/1971 | Hall et al. | 200/61.45 R X |
| 3,560,680 | 2/1971 | Clarke | 200/61.45 R |
| 3,571,539 | 3/1971 | Kaiser et al. | 200/61.53 |
| 3,671,690 | 6/1972 | Parlato | 200/61.45 R |

*Primary Examiner*—A. T. Grimley
*Assistant Examiner*—Morris Ginsburg
*Attorney, Agent, or Firm*—Arthur L. Plevy

[57] ABSTRACT

A seismic sensor is disclosed which essentially consists of a central annular member having an inner conductive periphery. The annular member is coaxially positioned around a center post located in a housing. The center post has four extending surface slots into which are inserted tines or upstanding flanges associated with first and second contact members. The contact members enable the sensor to be mounted in four distinct positions, thus giving the installer great flexibility.

9 Claims, 3 Drawing Figures

SEISMIC SENSOR APPARATUS

BACKGROUND OF INVENTION

This invention relates to a seismic sensor and more particularly to apparatus for responding to vibrations or impulse forces.

The term seismic is generally associated with earthquakes or attendant shaking of various structures which occurs during such an earthquake. Essentially a sensor device which has the capability of responding to a shock or vibration can generally be referred to as a seismic sensor. Such devices have found widespread use in regard to intrusion type systems. Such systems serve to monitor a premise to guard against unauthorized entry. It is, of course, well known that a burglar or other person could attempt to break a glass pane or a door or other structure to gain unauthorized access to a monitored area. In this manner, such sensors have been employed to respond to shock or vibratory forces which would normally accompany such a break-in.

In any event, the prior art is replete with a number of devices which are employed as shock and vibration sensors. Certain of these devices are generically referred to as accelerometers and will respond to an acceleration or force in a given plane. Accelerometer devices or vibration detectors, based on acceleration, are extremely expensive as they require various transducers such as those employing piezoresistive devices, variable reluctance, magnetostrictive as well as piezoelectric devices. Hence, the prior art, especially in the field of intrusion detection, sought to replace these devices with a simpler structure.

Thus, an extremely early arrangement of a mechanical vibration sensor is depicted in German Pat. No. 262,949. This patent employs a conductive sphere which is mounted upon conductive contacts arranged as a tripod. In this manner, vibration would cause the sphere to move away from the contacts, thus indicating an alarm. This feature is also disclosed in U.S. Pat. No. 3,560,680 issued on Feb. 2, 1971. Both structures are normally associated with unreliable operation and exhibit many false alarms when employed in conjunction with an intrusion system.

Other prior art devices employ a toroidal mass which also serves to sense shock or vibration in a particular manner and in a particular orientation. These devices are not acceptable for use in conjunction with intrusion systems. A particularly interesting device is depicted in U.S. Pat. No. 4,025,744 entitled SHOCK AND VIBRATION SENSITIVE SWITCH issued on May 24, 1977 to L. J. Kniskern. This patent purports to circumvent many of the problems of prior art and contains a number of additional references in the Background of Invention. The patent describes a shock and vibration sensor which includes a toroidal shaped disk having an outer conductive periphery. The disk is supported by two sharp penetrating contacts. The contacts engage the outer peripheral surface of the disk and when the sensor unit is subjected to a force or vibration, the toroidal disk moves, thus breaking contact and indicating an alarm condition.

There presently exists many detection circuits which will monitor the nature of the openings to determine whether a valid intrusion has occurred and systems for doing so are well known in the art. Accordingly, the sensor depicted in the above noted patent can be employed in an intrusion system to monitor unauthorized entries. An extreme problem associated with this transducer is that it has a limited capability in regard to mounting the same on a surface to be protected. The sensor depicted in this patent can only be mounted in two orientations; both of which are vertical and differ from each other by 180°. In order to accomplish this, a particular set of contacts is necessary. The contact arrangement is depicted in the patent and incorporates two large C-shaped contact members which can engage the outer periphery of the disk dependent upon the disk orientation. Apart from this problem is the general problem of sensitivity of the structure as well as requiring a large conductive surface which is analogous to the entire outer surface of the toroid.

It is therefore an object of the present invention to provide an improved sensor which is extremely compact in configuration and which can be mounted in four distinct rotational positions to thereby give a user greater flexibility in mounting the device. The sensor to be described is more economical in that it does not require any conductive outer periphery to be employed, but uses a unique contact configuration operative with a conductive area on the inner periphery of an annular or toroidal member.

BRIEF DESCRIPTION OF THE PREFERRED EMBODIMENT

A seismic sensor device for responding to shock and vibration, comprising an annular member having a conductive inner periphery, a housing having a center post, a pair of contacts positioned about said center post and operative to contact and support said annular member by coacting with the inner periphery.

DETAILED DESCRIPTION OF THE INVENTION

Figure 1:
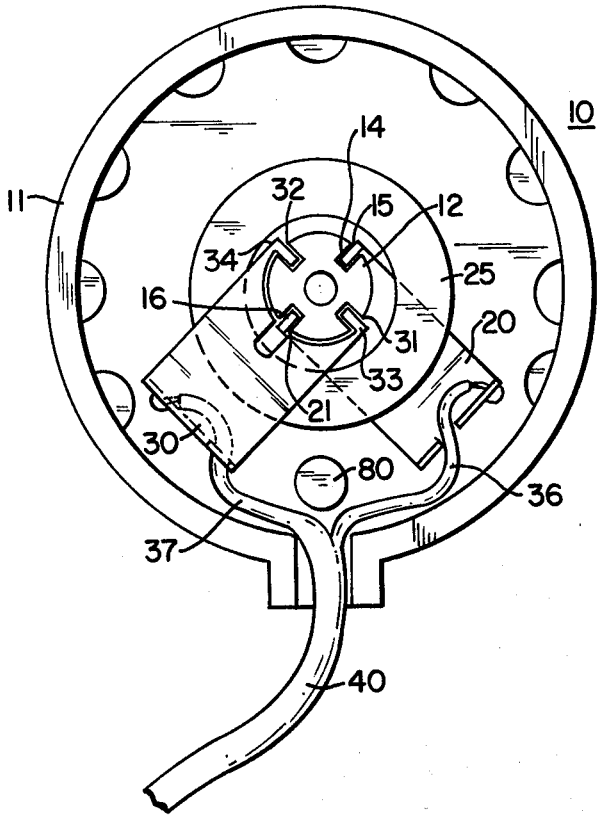
FIG. 1 is a front plan view showing a seismic sensor apparatus according to this invention.

Referring to FIG. 1, there is shown a seismic sensor according to this invention. As will be explained, the sensor structure is mounted in a circular housing 11 fabricated from a plastic. It is, of course, understood that the geometrical configuration of the housing may vary. The circular configuration is relatively small in diameter and may, for example, vary between one to three inches depending upon the application.

Integrally formed with the housing is a central post 12 which has four extending surface slots 14 21, 31 and 32 positioned about the periphery of the housing post. The slots 14, 21, 31 and 32 are on the outer surface of the post 12 and extend from the top to the bottom of the post. Located in the slots, as will be further explained, are upstanding flanges or tines as 15 16, 33 and 34. There are two tines associated with a contact member. For example, in FIG. 1, there is shown a lower contact assembly 20 which has a first upstanding tine 15 located in slot 14 and a second upstanding tine 16 located in slot 21.

Positioned above the lower contact 20 is an annular member or toroid 25. The toroid 25 has at least the inner surface thereof plated or coated with a conductive material such as gold. In order to expedite matters, the entire toroid 25 may be plated as well.

The FIG. also depicts an upper contact member 30 which, as will be explained, is identical in structure and configuration with contact 20. In any event, the upper contact 30 is inserted into slots 31 and 32 of the center post 12 with the flange member or tines 33 and 34 depending downwardly into the associated slots 31 and 32. Each contact is coupled to an associated wire as 36 and 37. The above description represents the basic structure and more details of the construction and structure will be given subsequently.

Figure 2:
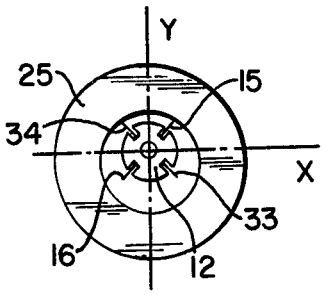
FIG. 2 is a simple diagrammatic view to assist in explaining the operation of the invention.

Referring to FIG. 2, there is shown a simplified diagram used to explain operation of the seismic sensor according to FIG. 1. Similar reference numerals have been retained to indicate similar functioning parts.

As seen from FIG. 2, the toroidal member 25 rests in the vertical position of FIG. 1 on contacts 15 and 34 which are equivalent to tines 15 and 34. In the position shown, if the housing of the sensor or the surface upon which the housing is mounted is subjected to a shock or vibratory force, the vibration will cause the toroid to rock or jump, thus breaking contact between contacts 34 and 15.

One can now ascertain from the diagrammatic view of FIG. 2 that the unit can be positioned in four distinct positions along the X-Y axis or the horizontal and vertical axis. Hence, in the positions shown in FIG. 2, the toroid 25 is seated on contacts 15 and 34. The unit can also be mounted 90° in either direction of that shown. If the unit is rotated 90° in a counterclockwise direction, the toroid rests on contacts 15 and 33 and hence, the wire or cable 40 which contains conductors 36 and 37 can be directed towards the right. This enables an assembler great versatility in using the sensor in an intrusion system.

The ability to rotate a wire is extremely important as an alarm installer or constructor wishes to achieve the maximum concealment of the wires as, for example, to position the cable as 40 behind curtains, drapes, carpets and so on. Hence, as one can see from FIG. 2, the unit can be rotated at 90° intervals and therefore mounted in four distinct positions enabling contact between one contact element or tine associated with contact 20 and another contact element or tine associated with contact 30. Furthermore, as one can also ascertain, the full weight of the toroid is, in fact, carried by the contacts which further assure good and proper contact.

Figure 3:
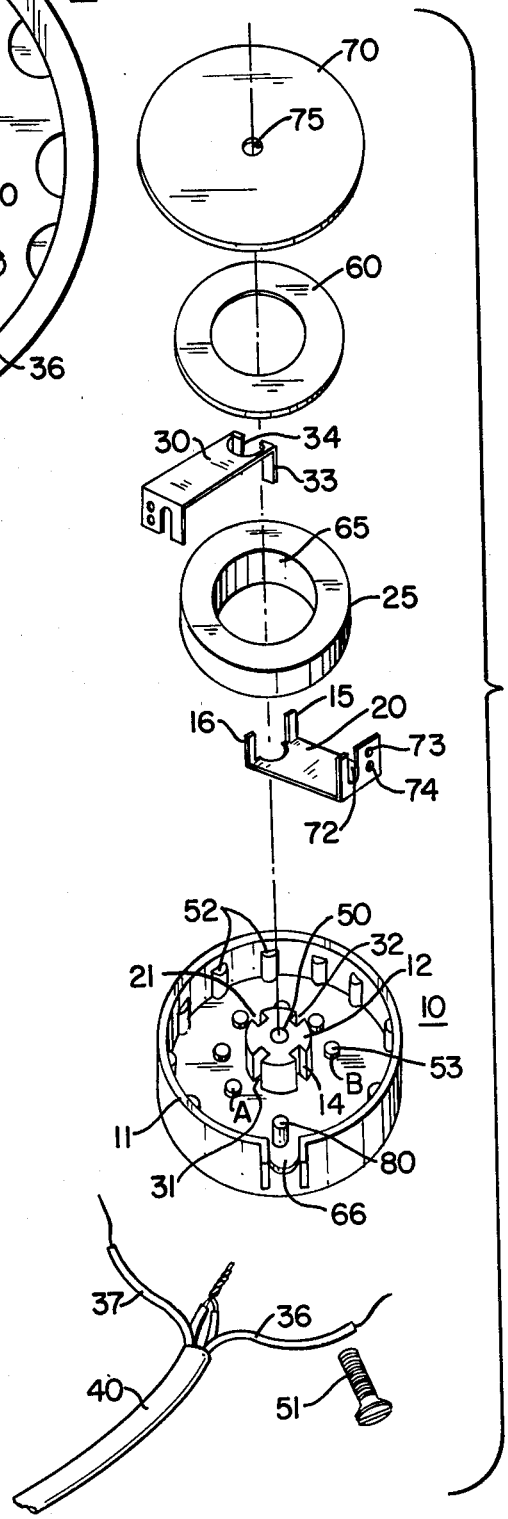
FIG. 3 is a perspective view depicting the assembly of the seismic sensor according to this invention.

Referring to FIG. 3, there is shown an assembly drawing of the unit depicted in FIG. 1 to give one a clear explanation of how the structure assembles and hence, to gain a clear understanding of operation. Again, similar reference numerals have been retained to indicate similar functioning parts.

The housing 11, as indicated, is fabricated from a suitable plastic which may be directly molded by many techniques in the configuration shown. The central post 12 has a central aperture 50 for purposes of receiving a retainer screw 51 to secure the assembled sensor to a suitable surface.

Located about the inside periphery of the housing 11 are a series of half round peripheral bosses as 52 which form a support for the housing cover. Positioned about the center post are a plurality of dome top posts as 53. These posts act as a seat to prevent the toroid from touching the base of the lower contact. The lower contact is placed between the bosses A and B as shown in FIG. 3.

The lower contact 20 possessing the tines 15 and 16 is inserted as shown in the FIG. so that the tines are positioned within slots 14 and 21 of the central post 12. The toroid 25 is then placed above the lower contact and is held out of contact with the same by means of the dome posts 53. The upper contact 30 is then placed in position so that its tines 34 and 33 are seated in slots 31 and 32 of the center post 12.

An insulating washer 60, which may be fabricated from a suitable plastic, is placed on top of the toroid so that the sides of the toroid 25 may be effectively insulated from the contacts prior to insertion of the upper contact 30. This extra insulator need not be employed, for example, if only the inner peripheral area 65 of the toroid is plated.

The unit thus assembled now receives the cover 70 which rests upon the peripheral bosses 52. Prior to insertion of the cover 70, the wire cable 40 is directed into a side aperture 66 in the sidewall of the housing 11. Wire 37 is soldered to contact 30 and wires 36 soldered to contact 20. The wires are positioned as shown in FIG. 1 through the U-shaped aperture as 72 of contact 20 and secured within apertures 73 and 74 to provide a good strong assembly. There is also a post 80 depicted in FIG. 1 and FIG. 3, which post prevents the wire from being pushed too far into the housing which would prevent the free movement of the toroid.

Once the unit is assembled as shown in FIG. 3, the cover 70 can be placed on the unit and glued in place or otherwise secured. The aperture 75 in the cover is coaxial with aperture 50 in the housing and hence, the retaining screw as 51 can be used to affix the sensor, if desired, to a plastic, wood or similar surface. The sensor can also be employed on other surfaces which would not be penetrated by a screw by means of a suitable adhesive or tape.

The sensor thus described is extremely reliable in operation and is extremely simple to fabricate. For example, the base 11 or the bottom housing is simply molded with the center post and the slots as well as the bosses and posts in a simple operation. The upper and lower contacts as 20 and 30 are of identical configuration, but are inserted into the housing inverted with respect to one another. The toroid, which may be fabricated from brass and plated, need only have its inner periphery 65 conductive. The washer 60 again is a very simple and readily available component.

In essence, the entire structure requires only four parts which essentially, are the housing 11, the two contacts 20 and 30 and the toroid 25. The unit, as indicated, is capable of operating in any one of four unique positions, which positions enable the wire 40, which is to be eventually connected to the intrusion system, to be routed in different directions as emanating from the top, bottom or the sides. This gives the user great flexibility.

While the above description depicts a preferred embodiment of the invention, it is distinctly understood that many alternative configurations will be discerned by those skilled in the art and therefore, the invention is not to be deemed limited by the above description without reference to the following claims appended hereto.

I claim:

1. A seismic sensor device for responding to shock and vibration, comprising:

a housing having a center post, with a first contact member supported by said post in a first position, said contact member having two upstanding flanges indicative of a first and a second contact, a second contact member supported by said post and positioned above said first contact member in a second position, said second contact member having two flanges indicative of third and fourth contacts, an annular member positioned in said housing and between said contact members and having a conductive inner periphery and with a central aperture thereof positioned about said center post, to cause said annular member to be supported in a plurality of positions by each of said contact members with each of said positions indicative of one flange from said first contact member and one flange from said second contact member supporting the same, whereby said conductive inner periphery together with said two flanges contacting the same provides a closed circuit in a first position and due to a shock or vibration said annular member moves to break contact with at least one of said flanges indicative of a shock condition manifesting an opened circuit.

2. The seismic sensor device according to claim 1 wherein said center post has four extending slots positioned about the outer surface of said post and directed from the top to the bottom of said post, with said first contact member having said two upstanding flanges inserted into two opposed slots, and with said second contact member having said two upstanding flanges inserted into two other opposed slots.

3. The seismic sensor device according to claim 1 wherein said annular member is a toroid.

4. The seismic sensor device according to claim 2 wherein said slots are positioned one from the other at ninety degree intervals about said center post with opposed slots positioned about the same diameter, to allow said sensor to assume any one of four distinct vertical mounting positions.

5. The seismic sensor device according to claim 2 wherein said housing includes a plurality of extending projections located about said center post for positioning said annular member above said first contact member.

6. A seismic sensor device for responding to shock and vibration, comprising:

a housing having a center post with four radial slots positioned about the periphery at intervals of approximately ninety degrees, with said slots directed from the top to the bottom of said housing;

a first contact member positioned in said housing, said first contact member having two upstanding tine like projections inserted into two opposing radial slots relatively on the same diameter of said post;

a toroidal member positioned in said housing above said first contact member and having a conductive inner periphery positioned about said center post;

a second contact member positioned in said housing, and having two depending tine like projections inserted into the other two opposing slots and positioned above said toroidal member, whereby one tine of each contact member is in contact with said conductive inner periphery to support said toroidal member in any one of four unique positions, whereby when said housing is subjected to a force, said toroidal member moves off a contact to provide an indication of said force.

7. The seismic sensor device according to claim 6 further including:

a plurality of dome topped posts positioned peripherally about a section of said center post to position said toroidal member above said first contact member.

8. The seismic sensor device according to claim 6 further including:

a cable accommodating aperture located in a sidewall of said housing, with a cable inserted and connected to said first and second contact members.

9. The seismic sensor device according to claim 8 further including a post located in said housing adjacent said cable accommodating aperture to restrain the penetration of said cable into said housing.

* * * * *